US006499313B2

(12) United States Patent
Spoeri et al.

(10) Patent No.: US 6,499,313 B2
(45) Date of Patent: Dec. 31, 2002

(54) PROCESS AND APPARATUS FOR GENERATING HIGH-PURITY NITROGEN BY LOW-TEMPERATURE FRACTIONATION OF AIR

(75) Inventors: Ralph Spoeri, Geretsried (DE); Stefan Lochner, Grafing (DE)

(73) Assignee: Linde Aktiengesellschaft, Wieshbaden (DE)

( * ) Notice: Subject to any disclaimer, the term of this patent is extended or adjusted under 35 U.S.C. 154(b) by 0 days.

(21) Appl. No.: 09/950,810

(22) Filed: Sep. 13, 2001

(65) Prior Publication Data

US 2002/0066289 A1 Jun. 6, 2002

(30) Foreign Application Priority Data

Sep. 13, 2000 (DE) ..... 100 45 128

(51) Int. Cl.[7] ..... F25J 3/00

(52) U.S. Cl. ..... 62/650; 62/651

(58) Field of Search ..... 62/650, 651

(56) References Cited

U.S. PATENT DOCUMENTS

| | | | | |
|---|---|---|---|---|
| 4,578,095 A | | 3/1986 | Erickson | 62/22 |
| 5,402,647 A | | 4/1995 | Bonaquist et al. | 62/24 |
| 5,596,886 A | | 1/1997 | Howard | 62/646 |
| 5,802,874 A | * | 9/1998 | Voit | 62/650 |
| 6,257,019 B1 | * | 7/2001 | Oakley et al. | 62/650 |

* cited by examiner

*Primary Examiner*—Ronald Capossela
(74) *Attorney, Agent, or Firm*—Millen, White, Zelano & Branigan, P.C.

(57) ABSTRACT

High-purity nitrogen is generated by low-temperature fractionation of air in a rectification system for nitrogen/oxygen separation having at least a first rectifier column (4). Cycle nitrogen (24) in gas form is removed from the upper region of the first rectifier column (4) and is compressed in a cycle compressor (30). A first part (35) of the compressed cycle nitrogen is liquefied. A nitrogen fraction (52) from the rectification system for nitrogen/oxygen separation is introduced (52) into a high-purity nitrogen column (39) having a top condenser (54). High-purity nitrogen (56) is removed from the upper region of the high-purity nitrogen column (39). The refrigeration demand of the top condenser (54) is at least partially covered by liquefied cycle nitrogen (38).

15 Claims, 1 Drawing Sheet

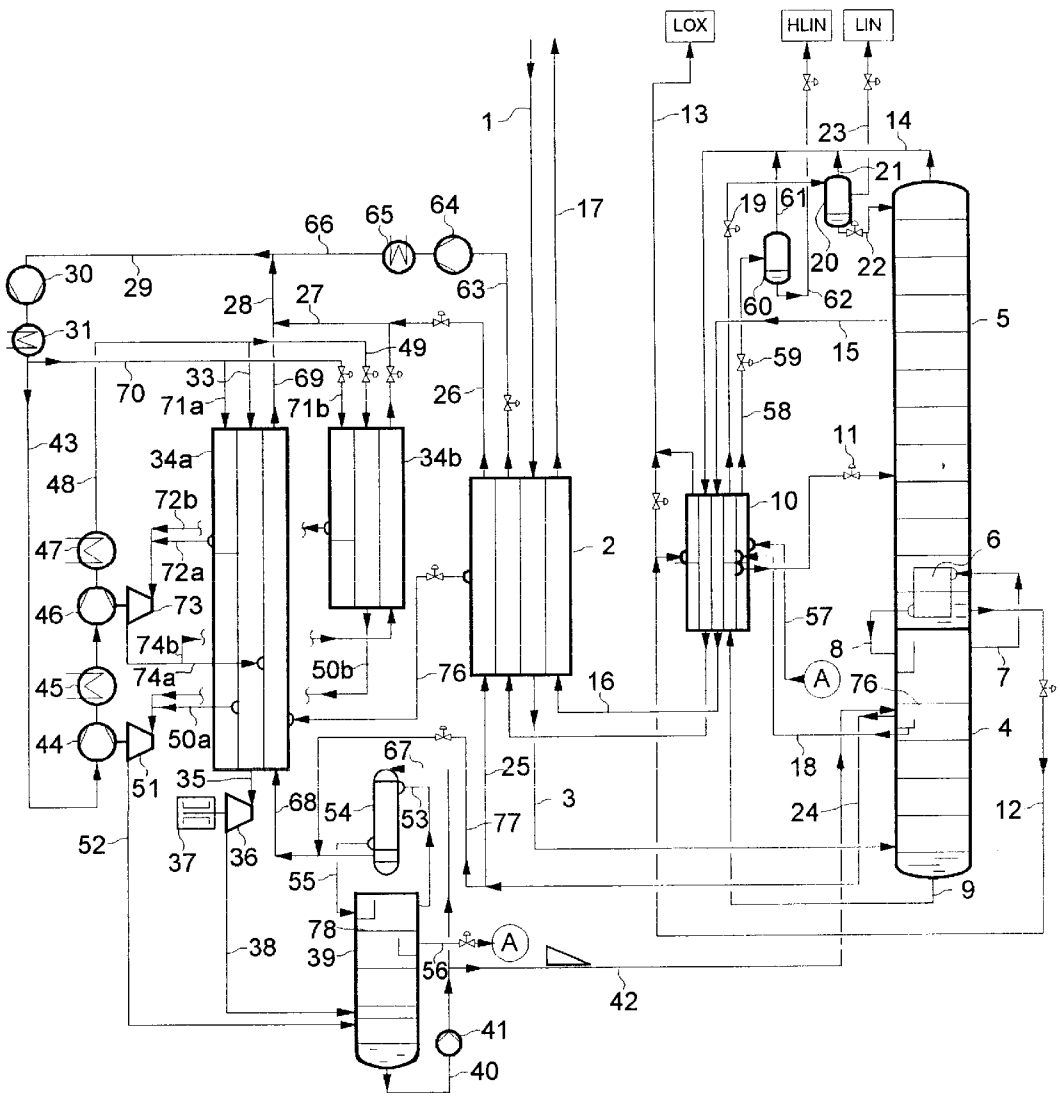
LIN
HLIN
LOX
A
A

PROCESS AND APPARATUS FOR GENERATING HIGH-PURITY NITROGEN BY LOW-TEMPERATURE FRACTIONATION OF AIR

The invention relates to a process and apparatus for generating high-purity nitrogen by low-temperature fractionation of air, including both a rectification system for nitrogen/oxygen separation, and a high-purity nitrogen column, in which the high-purity product is generated from a nitrogen fraction which has been obtained in the rectification system for nitrogen/oxygen separation.

The rectification system for nitrogen/oxygen separation may be designed as a one-column, two-column or multi-column system. It is preferable to use a conventional Linde double-column process. The principles of the low-temperature fractionation of air in general and the structure of double-column installations specifically are known from the monograph "Tieftemperaturtechnik" [Low-temperature technology] by Hausen/Linde ($2^{nd}$ edition, 1985) or from an article by Latimer in Chemical Engineering Progress (Vol. 63, No. 2, 1967, Page 35). In addition to the rectification system for nitrogen/oxygen separation, further apparatus for obtaining other constituents of air, in particular high-purity oxygen or inert gases, such as for example argon, maybe used in the process according to the invention.

A process for obtaining high-purity nitrogen with a reduced CO content by rectification is known from European patent EP 299364 B1. The removal of CO and, if appropriate, the removal of argon in this case takes place in the upper region of the high-pressure part of the double column for nitrogen/oxygen separation. A drawback of this process is that only a small part of the overall nitrogen product can be obtained in high-purity form; most has to be tapped off as nitrogen of ordinary purity, in particular without a reduction in the CO content (and if appropriate in the argon content).

The invention is based on the object of providing a process and an apparatus which allow a particularly high proportion of the nitrogen product to be obtained in high-purity form, in particular with a reduced CO concentration.

This object is achieved by a process for a generating high-purity nitrogen by low-temperature fractionation of air in a rectification system for nitrogen/oxygen separation, which has at least a first rectifier column (4), in which process a. cycle nitrogen (24) in gas form is removed from the upper region of the first rectifier column (4), and
b. is compressed in a cycle compressor (30),
c. a first part (35) of the compressed cycle nitrogen is liquefied,
d. a nitrogen fraction (52) from the rectifier system for nitrogen/oxygen separation is introduced (52) into a high-purity nitrogen column (39) which has a top condenser (54),
e. high purity nitrogen (56) is removed from the upper region of the high-purity nitrogen column (39), and
f. the refrigeration demand of the top condenser (54) of the high-purity nitrogen column (39) is at least partially covered by liquefied cycle nitrogen (38).

Thus, a high-purity nitrogen column whose refrigeration demand is covered by the liquid nitrogen which is generated in a nitrogen cycle is used. A cycle of this type is used to generate large quantities of liquid product and is known per se. A significant concept of the invention is the advantageous connection of this liquefaction cycle to the high-purity nitrogen column.

To transfer the refrigeration from the liquefied cycle nitrogen to the top fraction of the high-purity nitrogen column, the following variants are possible and can also in principle be implemented in any combination:

i) direct introduction of the liquefied cycle nitrogen into the evaporation space of the top condenser of the high-purity nitrogen column
ii) introduction of the liquefied cycle nitrogen into the high-purity nitrogen column (at the bottom or a few plates above it), removal of a liquid from the high-purity nitrogen column (for example at the bottom) and introduction of this liquid (the composition of which is very similar or identical to that of the liquefied cycle nitrogen) into the evaporation space of the top condenser of the high-purity nitrogen column
iii) introduction of the liquefied cycle nitrogen into another vessel (for example the first rectification column), removal of a liquid of identical or similar composition from this vessel and introduction of this liquid (the composition of which is very similar or identical to that of the liquefied cycle nitrogen) into the evaporation space of the top condenser of the high-purity nitrogen column which is in communication with a first rectifier column of the rectification system for nitrogen/oxygen separation not directly but rather via a nitrogen cycle. For this purpose, the high-purity nitrogen column is fed with gaseous cycle nitrogen, which is preferably introduced into the lower region of the high-purity nitrogen column, from the or one of the expansion turbines of the nitrogen cycle. Within the high-purity nitrogen column, the rising vapour is enriched with constituents of relatively low volatility, in particular CO and/or argon, by counter current rectification. The nitrogen product, which is of correspondingly high purity, is removed from the upper region of the high-purity nitrogen column. On account of the cycle which is present, some or preferably all of the high-purity nitrogen product can be removed in liquid form and introduced, for example, into a tank.

In the process according to the invention, the integration of the cycle and the high-purity nitrogen column allows virtually any desired degree of conversion to be achieved in the high-purity nitrogen column by suitably designing or operating the nitrogen cycle. This allows flexible adaptation of the process to meet specific customer requirements. For example, it is possible to generate the entire useable nitrogen product in high-purity form, without nitrogen of standard purity being produced as a by-product. This is particularly favourable when the products of the process are—as is frequently the case—being introduced into liquid tanks, since one tank for the high-purity nitrogen is now sufficient instead of the two nitrogen tanks for the different purities which are required according to the prior art. Moreover, the process according to the invention allows the quantity of high-purity nitrogen which is generated to be varied during operation.

Preferably, at least a first part-stream of liquefied cycle nitrogen is fed back into the rectification system for nitrogen/oxygen separation, in particular into the first rectifier column. Consequently, the refrigeration which is generated in the cycle can be used to obtain liquid products directly from the rectification system for nitrogen/oxygen separation. In this case, by way of example, liquid nitrogen of standard purity and/or liquid oxygen are generated.

The integration between circuit system and high-purity nitrogen column can be improved further by removing the gaseous charge for the high-purity nitrogen column at least partially from the nitrogen cycle. For this purpose, a second part of the compressed cycle nitrogen is expanded and introduced into a high-purity nitrogen column. The expansion of the second part of the compressed cycle nitrogen is preferably carried out in a work-performing manner.

In many cases, a particularly low concentration of highly volatile impurities, such as hydrogen, neon and/or helium is also desirable in the high-purity nitrogen product. For this purpose, it is advantageous if the cycle nitrogen is removed at least one theoretical or practical plate below the top of the first rectifier column and/or the high-purity nitrogen is removed at least one theoretical or practical plate below the top of the high-purity nitrogen column. Preferably, in each case one to five, preferably two to three what are known as barrier plates are situated at the top of the first rectifier column or of the high-purity nitrogen column. These two measures both reduce the levels of highly volatile components in the high-purity nitrogen; they maybe employed individually or in combination.

Furthermore, it is expedient if reflux for the high-purity nitrogen column is generated in a top condenser by evaporating a second part-stream of the liquefied cycle nitrogen in a top condenser of the high-purity nitrogen column against condensing top gas from the high-purity nitrogen column. The cycle nitrogen which is evaporated in the top condenser of the high-purity nitrogen column is preferably returned to the cycle compressor, for example by being mixed with the cycle nitrogen coming from the first rectifier column. A procedure of this nature also supplies the process refrigeration required to operate the high-purity nitrogen column from the nitrogen cycle. For this purpose, a slightly lower pressure must prevail in the evaporation space of the top condenser than in the top of the high-purity nitrogen column, so that the corresponding temperature difference can drive the heat transfer at the top condenser. The operating pressure at the top of the high-purity nitrogen column is, for example, equal to the pressure at the top of the first rectifier column.

The second part-stream of the liquefied cycle nitrogen may, for this purpose, be passed directly from the cycle to the evaporation space of the top condenser of the high-purity nitrogen column. Preferably, however, it is firstly introduced into the high-purity nitrogen column, than tapped off from the lower region of the high-purity nitrogen column and then fed for evaporation in the top condenser of the high-purity nitrogen column.

The first part-stream of the liquefied cycle nitrogen can also be introduced into the high-purity nitrogen column, for example together with the second part-stream. It is then likewise tapped off from the lower region of the high-purity nitrogen column and then returned to the rectification system for nitrogen/oxygen separation.

The liquefied cycle nitrogen (first part of the compressed cycle nitrogen) must be expanded upstream of the point where it is divided into the first and second part-streams, or at the point where it is introduced into the first rectifier column. This expansion step maybe carried out by means of a restrictor valve. In the process according to the invention, it is expedient if it is carried out in a work-performing manner. For this purpose, the corresponding part-stream of the cycle nitrogen, for example in the supercritical state, enters a turbine, where it is expanded, without a phase transition, to a subcritical pressure, so that it emerges from the turbine completely in the liquid phase or substantially completely in the liquid phase (gas content for example up to about 5%). Alternatively, it is also possible to feed the turbine with cycle nitrogen which is already in liquid form at subcritical pressure. Preferably, the first and second part-streams of the first part of the cycle nitrogen are together expanded in a work-performing manner, then are together introduced into the high-purity nitrogen column, and the division into the first and second part-streams then takes place downstream of the high-purity nitrogen column.

It is preferable to use a two-turbine circuit, in which a third part of the compressed cycle nitrogen is expanded in a work-performing manner and is at least partially returned to the cycle compressor, the entry temperature of the work-performing expansion of the third part of the compressed cycle nitrogen being higher than the entry temperature of the work-performing expansion of the second part of the compressed cycle nitrogen. The fraction which is processed further in the high-purity nitrogen column therefore flows through the cold turbine. The third part-stream, after the work-performing expansion, is preferably returned to the entry to the cycle compressor, for example together with the cycle nitrogen from the first rectifier column.

In principle, it is also possible for the nitrogen from the warm turbine or from both turbines to be introduced into the high-purity nitrogen column.

In this case, it is expedient if the exit pressure of the work-performing expansion of the third part of the compressed cycle nitrogen is lower than the exit pressure of the work-performing expansion of the second part of the compressed cycle nitrogen. This method of operation on the one hand allows particularly efficient operation of the two turbines in which gaseous cycle nitrogen is expanded; on the other hand, the higher pressure of the second part is utilized to operate the high-purity nitrogen column.

In the invention, by way of example the following pressures and temperatures prevail in the various process steps: operating pressure of the first rectifier column (e.g. high-pressure part of a double column) at the top:

for example 5 to 12 bar, preferably 6 to 8 bar exit pressure of the circuit compressor:

for example 22 to 63 bar, preferably 28 to 37 bar entry pressure of the cold turbine (second part of the compressed cycle nitrogen):

for example 50 to 70 bar, preferably 58 to 63 bar exit pressure of the cold turbine:

for example 4 to 11 bar, preferably 6.5 to 8.5 bar entry temperature of the cold turbine:

for example 150 to 175 K, preferably 155 to 170 K entry pressure of the warm turbine (third part of the compressed cycle nitrogen):

for example 22 to 63 bar, preferably 28 to 37 bar exit pressure of the warm turbine:

for example 5 to 12 bar, preferably 6 to 8 bar entry temperature of the warm turbine:

for example 250 to 270 K pressure of the cycle nitrogen which is to be liquefied:

for example 50 to 70 bar, preferably 35 to 68 bar operating pressure of the high-purity nitrogen column at the top:

for example 5 to 12 bar, preferably 6.5 to 8.5 bar pressure in the evaporation space of the top condenser of the high-purity nitrogen column:

for example 4.5 to 11.5 bar, preferably 6 to 8 bar

The invention also relates to an apparatus for generating high-purity nitrogen by low-temperature fractionation of air in accordance with Patent claim 10.

The invention, as well as further details of the invention, are explained in more detail below with reference to an exemplary embodiment which is illustrated in the drawing.

Air 1 which has been compressed to a pressure of 6.5 bar and from which water vapour and carbon dioxide have been removed is cooled to approximately its dew point in a principal heat exchanger 2 and is fed via a line 3 to a high-pressure column 4, which in this example represents the "first rectifier column". The high-pressure column 4 is part of the rectification system for nitrogen/oxygen separation, which in this case also comprises a low-pressure column 5. In this arrangement, the two columns 4 and 5 are operated at a pressure of 6.2 bar and 1.3 bar (in each case at the top), respectively. They are in heat-exchanging communication via a principle condenser 6, where top nitrogen 7 from the high-pressure column 4 is condensed against evaporating bottom liquid from the low-pressure column 5; the condensate 8 which is formed in the process is added as reflux to the high-pressure column 4.

Via line 18, liquid nitrogen is discharged from the high-pressure column 4, specifically at a location two plates 76 below the top. (These barrier plates are used to retain highly volatile impurities, which can be extracted as non-condensable gas via an outlet (not shown) on the principle condenser.) The liquid nitrogen 18 is supercooled in a supercooling counter current heat exchanger 10, is expanded to just above the pressure of the low-pressure column by means of a restrictor valve 19 and is introduced into a separator 20. Flash gas 21 from the separator is admixed with the top nitrogen 14. Liquid is fed out of the separator 20 to the low-pressure column as reflux via line 22. If desired, a liquid product (LIN) can also be tapped off via line 23.

The oxygen-enriched bottom liquid 9 is supercooled in the supercooling counter current heat exchanger 10 and is introduced into the low-pressure column 5 via a restrictor valve 11. Liquid oxygen 12 is tapped off from the bottom of the low-pressure column 5 and—if appropriate after supercooling in the supercooling counter current heat exchanger 10—is tapped off as liquid product (LOX) via line 13. (Alternatively or in addition, gaseous oxygen may be discharged from the lower region of the low-pressure column 5.) Gaseous nitrogen 14 of ordinary purity, which in the example still contains 150 ppm of relatively low-volatility components, in particular argon and CO, is removed as top product from the low-pressure column 5. Impure nitrogen from the low-pressure column 5 is heated via the lines 15, 16, 17 in the supercooling counter current heat exchanger 10 and in the principle heat exchanger 2 and, if appropriate, is used as regeneration gas for an air-purification apparatus (not shown).

The high-pressure column 4 is connected to a nitrogen cycle. For this purpose, cycle nitrogen 24 is removed in gas form from the upper region of the first rectifier column (high-pressure column) 4. (Its composition is virtually identical to that of the top nitrogen 14 from the low-pressure column.) In this example, the removal takes place at the same intermediate location at which the liquid nitrogen 18 for the low-pressure column is also removed, namely below the barrier plates 76. (The barrier plates 76 can also be dispensed with; in this case, the cycle nitrogen is removed from the first rectifier column at its top.) At least a part 25 of the gaseous cycle nitrogen is heated to approximately ambient temperature in the principle heat exchanger 2 and, via the lines 26, 27, 28, 29, is fed to the inlet of a cycle compressor 30, where it is compressed to approximately 30 bar.

After removal of the heat of compression in a further cooler 31, a first part of the cycle nitrogen which has been compressed in the cycle compressor 30 is successively passed, via line 43, through the further compressors 44, 46 (each followed by a further cooler 45, 47), where it is brought to a pressure of 60 bar, and is introduced, via the line 33, into a first cycle heat exchanger 34*a*, which together with a second cycle heat exchanger 34*b*, which is partially connected in parallel, forms a cycle heat exchanger system. The cooled first part 35 of the compressed cycle nitrogen in the supercritical state passes out of the cold end of the first cycle heat exchanger 34*a* into a liquid turbine 36, where it is expanded in a work-performing manner to 6.5 bar. The liquid turbine 36 is connected to a mechanical braking device 37, for example to a generator or an oil brake.

The expanded first part 38 of the cycle nitrogen is now in the liquid state and is fed into a high-purity nitrogen column 39, specifically one or more plates above the bottom of this column (or alternatively directly above the bottom of the high-purity nitrogen column). It is removed again via line 40, however after a slight change in composition. A first part-stream 42 is fed back into the high-pressure column 4, so that the nitrogen cycle is closed. If necessary, a pump 41 can be used to deliver the liquefied third part 40 of the cycle nitrogen.

A second part of the cycle nitrogen which has been compressed in the cycle compressor 30 is guided, together with the first part, through the further compressors 44 and 46 via the lines 43 and 48 and is then cooled to approximately 170 K in two branch streams (through lines 33–50*a* and 49–50*b*) in the cycle heat exchanger system 34*a*, 34*b*. At this intermediate temperature, which is higher than the temperature of the cold end, the second part of the cycle nitrogen is passed via the lines 50*a* and 50*b* to a cold turbine 51, where it is expanded in a work-performing manner to approximately 6.5 bar. The expanded second part 52 of the cycle nitrogen serves as gaseous charge for the high-purity nitrogen column 39 and is fed in directly above the bottom. It forms the vapour which rises in the high-purity nitrogen column 39.

Relatively low-volatility constituents, such as for example CO and/or argon, are washed out of the gaseous nitrogen by the counter current inside the high-purity nitrogen column 39. The top gas 53 of the high-purity nitrogen column 39 is virtually completely condensed (apart from an outlet which is not shown for highly volatile constituents) in a top condenser 54. The condensate 55 flows back into the high-purity nitrogen column 39 as reflux. The top condenser 54 is cooled by a part-stream 67 of the liquefied first part 40 of the cycle nitrogen. The vapour 68 which is formed in the process is heated in the first cycle heat exchanger 34 and is fed back to the entry to the cycle compressor 30 via the lines 69, 28 and 29. The two cycle heat exchangers 34*a*, 34*b* may also be designed as a common block (not shown).

High-purity nitrogen is tapped off in liquid form via a line 56. Two to three barrier plates 78 above the product removal point are used to retain highly volatile components. The liquid high-purity nitrogen 56 then flows onwards, via line 57, to the supercooling counter current heat exchanger 10. The supercooled high-purity nitrogen 58 is expanded to 1.4 bar in a restrictor valve 59 and is introduced into a separator 60. Flash gas 61 from the separator 60 is admixed with the top nitrogen 14 of the low-pressure column 5. The liquid is tapped off from the separator 60 as high-purity nitrogen product (HLIN) via line 62.

The nitrogen cycle is also fed by the top nitrogen 14 of the low-pressure column 5, which, after heating in the supercooling counter current heat exchanger 10 and in the principle heat exchanger 2, is fed to a feed gas compressor 64 via line 63. After compression to approximately the entry pressure of the cycle compressor 30 and further cooling 65, it flows via the lines 66 and 29 to the cycle compressor.

A third part 70 of the cycle nitrogen which has been compressed in the cycle compressor 30 is cooled to approximately 260 K in two branches 71*a*–72*a* or 71*b*–72*b* in the cycle heat exchanger system 34*a*, 34*b*, respectively. It enters a warm turbine 73 at this temperature via line 72 and, in this turbine, is expanded in a work-performing manner to approximately 6 bar. The expanded third part of the cycle nitrogen is fed back to the cycle heat exchanger system 34*a*, 34*b* via the lines 74*a* and 74*b* and, after heating, flows back to the cycle compressor 30.

The mechanical energy which is generated in the two turbines 51, 73 which are exposed to gases is used to drive the further compressors 44, 46. The turbines and further compressors are preferably directly mechanically coupled. Alternately, the turbines 51, 73 may be braked by generators; in this case, the entire cycle nitrogen is compressed exclusively in the cycle compressor 30 (not shown).

Compensating streams 76, 77 are used to optimize the heat transfer in the three heat-exchanger blocks 34*a*, 34*b*.

The process according to the invention can be varied in numerous ways compared to the exemplary embodiment.

For example, it is possible for the gaseous charge for the high-purity nitrogen column (line 52 in the drawing) to be tapped off upstream of the cycle compressor, for example at the outlet of the further cooler 65 of the feed gas compressor 64.

Instead of the liquid 38 from the cycle being introduced into the high-purity nitrogen column 39, this liquid may also be at least partially introduced directly into the evaporation space of the top condenser 54 of the high-purity nitrogen column or into the high-pressure column 4. In the latter case, the refrigerant for the top condenser 54 would have to be taken from the high-pressure column 4.

Particularly in plants in which there is no intention of obtaining any liquid oxygen, it is possible to dispense with feeding low-pressure column nitrogen 63 to the cycle and therefore to dispense with the feed gas compressor 64. In such cases, it will be appropriate to operate the double column 4/5 at elevated pressure and -to equip the low-pressure column 5 with a top condenser, as shown, for example, in DE 3528374 A1.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding German application 10045128.4, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for generating high-purity nitrogen by low-temperature fractionation of air in a rectification system for nitrogen/oxygen separation, which has at least a first rectifier column (4), said process comprising:

a. introducing compressed air into the first rectifier column (4), b. removing cycle nitrogen (24) in gas form from an upper region of the first rectifier column (4), and c. compressing the removed cycle nitrogen in a cycle compressor (30), d. liquefying a first part (35) of the compressed cycle nitrogen, e. introducing a nitrogen fraction (52) of the cycle nitrogen into a high-purity nitrogen column (39) which has a top condenser (54), f. removing high-purity nitrogen (56) from an upper region of the high-purity nitrogen column (39), g. cooling the top condenser (54) of the high-purity nitrogen column (39) at least partially by liquefied cycle nitrogen (40)(67), and h. removing oxygen from the rectification system.

2. A process according to claim 1, wherein at least a first part-stream (42) of the liquefied cycle nitrogen (38, 40) is fed back into the first rectifier column (4).

3. A process according to claim 2, in which the first part-stream of the liquefied cycle nitrogen is introduced (38) into the high-purity nitrogen column (39), is tapped off (40) from the lower region of the high-purity nitrogen column, and is then fed back (42) into the rectification system for nitrogen/oxygen separation.

4. A process according to claim 2, in which the first part (35) of the cycle nitrogen is expanded (36) in a work-performing manner upstream of the point where it is divided into the first and second part-streams.

5. A process according to claim 1, wherein a second part of the compressed cycle nitrogen is expanded (51) and introduced (52) into the high-purity nitrogen (39).

6. A process according to claim 5, wherein the expansion (51) of the second part of the compressed cycle nitrogen is carried out in a work-performing manner.

7. A process according to claim 6, in which a third part of the compressed cycle nitrogen (72*a*, 72*b*) is expanded (73) in a work-performing manner and is at least partially returned to the cycle compressor (30), the entry temperature of the work-performing expansion (73) of the third part of the compressed cycle nitrogen being higher than the entry temperature of the work-performing expansion (51) of the second part of the compressed cycle nitrogen.

8. Process according to claim 7, in which the exit pressure of the work-performing expansion (72) of the third part of the compressed cycle nitrogen is lower than the exit pressure of the work-performing expansion (51) of the second part of the compressed cycle nitrogen.

9. A process according to claim 1, in which the cycle nitrogen (24) is removed at least one theoretical practical plate (76) below the top of the first rectifier column, and/or the high-purity nitrogen (56) is removed at least one theoretical or practical plate (78) below the top of the high-purity nitrogen column (39).

10. A process according to claim 1, in which liquefied cycle nitrogen (67) is evaporated against condensing top gas (53) from the high-purity nitrogen column (39) in a top condenser (54) of the high-purity nitrogen column (39).

11. A process according to one of claim 10, wherein cycle nitrogen (68) which is evaporated in the top condenser (54) of the high-purity nitrogen column (39) is returned to the cycle compressor (30).

12. A process according to claim 1, wherein said first rectifier column is a high-pressure column and said rectification system further contains a low-pressure rectifier column.

13. Apparatus for generating high-purity nitrogen by low-temperature fractionation of air, comprising:

a rectification system for nitrogen/oxygen separation which has at least a first rectifier column (4), a line (1) to introduce compressed air into the rectification system, a cycle line (24, 25, 26, 27, 28, 29) for feeding gaseous cycle nitrogen out of an upper region of the first rectifier column (4) to a cycle compressor (30), means (34*a*, 36) for liquefying a first part (35) of the compressed cycle nitrogen, means (52) for introducing a nitrogen fraction into a high-purity nitrogen column (39), the high-purity nitrogen column having a top condenser (54), a product line for removing high-purity nitrogen (56) from the upper region of the high-purity nitrogen column (39), means for directly or indirectly introducing at least a part-stream of the liquefied cycle nitrogen into the evaporation space of the top condenser (54) of the high-purity nitrogen column, and means to remove oxygen from the rectification system.

14. An apparatus according to claim 13, in which one to five barrier plates are situated at the top of the first rectifier column or of the high-purity nitrogen column.

15. An apparatus according to claim 13, further comprising two turbines.

* * * * *

UNITED STATES PATENT AND TRADEMARK OFFICE

CERTIFICATE OF CORRECTION

PATENT NO. : 6,499,313 B2
DATED : December 31, 2002
INVENTOR(S) : Ralph Spoeri et al.

It is certified that error appears in the above-identified patent and that said Letters Patent is hereby corrected as shown below:

Title page,
Item [73], Assignee, should read -- Wiesbaden --

Signed and Sealed this

Fourteenth Day of October, 2003

JAMES E. ROGAN
*Director of the United States Patent and Trademark Office*